United States Patent [19]

Chin

[11] Patent Number: 4,702,782

[45] Date of Patent: Oct. 27, 1987

[54] HIGH MODULUS SHAFTS

[75] Inventor: Herbert A. Chin, West Palm Beach, Fla.

[73] Assignee: United Technologies Corporation, Hartford, Conn.

[21] Appl. No.: 934,972

[22] Filed: Nov. 24, 1986

[51] Int. Cl.[4] ..... C22F 1/10

[52] U.S. Cl. ..... 148/429; 148/11.5 N; 148/11.5 P; 148/426

[58] Field of Search ..... 148/11.5 N, 11.5 P, 148/404, 429, 426; 420/441, 460

[56] References Cited

U.S. PATENT DOCUMENTS 3,982,973 9/1976 Peters et al. ..... 148/11.5 N
4,110,131 8/1978 Gessinger ..... 148/11.5 N
4,328,045 4/1982 Pearson et al. ..... 148/404
4,481,047 11/1984 Winfree et al. ..... 148/429
4,518,442 5/1985 Chin ..... 148/11.5 N

*Primary Examiner*—L. Dewayne Rutledge
*Assistant Examiner*—Robert L. McDowell
*Attorney, Agent, or Firm*—Charles E. Sohl

[57] ABSTRACT

High modulus turbine shafts are described as are the process parameters for producing these shafts. The shafts have a high modulus as a result of having high modulus <111> crystal texture in the axial direction. The shafts are produced from a nickel base material consisting largely of the compound $Ni_3Si$. Hot axisymmetric deformation followed by cold axisymmetric deformation produces an intense singular <111> texture and results in shaft material whose Young's modulus is at least 25% greater than that of the steel materials used in the prior art.

6 Claims, 3 Drawing Figures

HIGH MODULUS SHAFTS

DESCRIPTION

TECHNICAL FIELD

This invention relates to high modulus articles and methods for producing the same.

BACKGROUND ART

This invention was developed with particular respect to gas turbine engine shafts and will be so described. The invention, however, is not limited to turbine engine shafts.

As commonly constructed, a gas turbine engine includes a hollow cylindrical case within which are mounted rows of stationary vanes, and a rotating shaft located axially within the hollow case upon which are mounted disks on whose circumferences are mounted a plurality of blades. Alternately arranged rows of moving blades and stationary vanes compress air and subsequent blade-vane combinations absorb energy produced by burning fuel with previously compressed air. Critical to the efficiency of such engines is the maintenance of minimum clearances between moving and stationary parts. The turbine shaft mounts the disks and blades for rotation and transmits power from the turbine section to the compressor section of the engine. Successful, efficient operation requires accurate location of the blades relative to the case. It is of the utmost importance that the turbine shaft be stiff and free from deflection and vibration (some vibration and deflection is unavoidable but the amount should be minimized). The stresses which produce deflection and vibration result from the engine operation and from externally applied loads resulting from aircraft motion.

Conventionally produced turbine shafts are fabricated from alloy steel and are hollow to derive the maximum specific stiffness.

The deflection under load of articles such as turbine shafts is inversely proportional to the modulus of elasticity, Young's modulus. Consequently, it is desirable to employ a shaft material having the highest possible modulus of elasticity to minimize deflections.

Metallic materials generally have a crystalline form, that is to say, individual atoms of the material have a predictable relationship to their neighboring atoms which extends in a repetitive fashion throughout a particular crystal or grain. The properties of such crystals vary significantly with orientation.

Most metallic articles contain many thousands of individual crystals or grains and the properties of such an article in a particular direction are reflective of average orientation of the individual crystals which make up the article. If the grains or crystals have a random orientation then the article properties will be isotropic, equal in all directions. Although widely assumed, this is rarely the case since most casting, deformation, and recrystallization processes produce a preferred crystal orientation or texture.

Textures have been extensively studied and practical use is made of textured materials, especially in the area of magnetic materials.

Crystals contain planes of atoms having particular spacings. These planes are identified by Miller indices of the form (111), (110), (100) etc. x-ray measurements can be made and texture intensities can be characterized as 1X, 5X random etc, with 5X random indicating a more intense texture than (for example) 2X random.

Metals that have undergone extensive deformation often display a "fibrous" macrostructure, especially when etched. Such a structure results from the alignment of inclusions, grain boundaries and second phases, but has no direct correlation with the crystallographic texture of the material, and should not be confused with the present invention.

It is an object of this invention to describe processing sequences which, when applied to a certain class of materials, can increase the Young's modulus or modulus of elasticity in the axial direction by as much as 25%.

It is also an object of this invention to describe the resultant high stiffness shafts.

DISCLOSURE OF INVENTION

According to the present invention, nickel base compositions which form a relatively ductile intermetallic compound ($Ni_3Si$), where various other elements can be substituted in part for Ni and Si, are processed by a combination of hot axisymmetric deformation and cold axisymmetric deformation to produce a product having a high modulus of elasticity in a predetermined direction.

The foregoing, and other features and advantages of the present invention, will become more apparent from the following description and accompanying drawings.

BEST MODE FOR CARRYING OUT THE INVENTION

Figure 1:
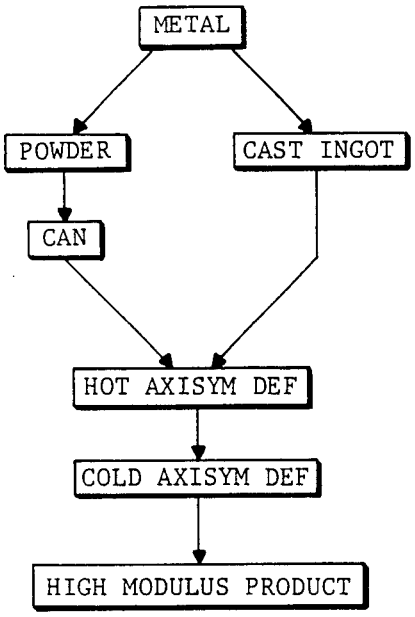
FIG. 1 is a flowchart of the invention process.

The present invention concerns the fabrication of articles utilizing a combination of composition and processing to produce an article having a high modulus along a particular axis.

The material to which the present invention process can be applied is based on the intermetallic phase $Ni_3Si$, where X can be any of several elements which substitutes for silicon. On an atomic basis the preferred composition is 75 at.% nickel and 25 at.% (silicon+X). This composition will provide about 100% (by volume) of the desired gamma prime phase, at a minimum then must be about 50% percentage of the gamma prime phase. It is preferred that the amount of silicon+X not exceed about 27 at.% to prevent forming undesirable brittle phases such as $Ni_5Si_2$. If (Si+X) is slightly less than about 25 at.% a mixture of the desired phase and a nickel solid solution (gamma phase) which is not deleterious to texture formation is formed. Therefore, the (Si+X) should constitute from about 15% to about 25% on an atomic basis and preferably from about 20% to about 25% of the material.

Table I shows the approximate upper limit for single additions to $Ni_3Si$ which can be made without forming new phases. The amounts of plural Table I elements which can be added without forming extra phases are not so easily defined since there is likely to be interactions between additions. As a starting point one should sum the fractions of the maximum amounts being added (and keep the sum at less than 1.0). Thus 6% Ti (half of the maximum of 12%) would be more likely to succeed with 2% V (one quarter the maximum of 8%) than with 2% Mn (two thirds of the maximum of 3%) since $\frac{1}{2}+\frac{2}{3}$ exceeds 1.0. The skilled artisan can obviously also employ known analytical metallurgical techniques such as metallography and x-ray diffractions to confirm that no deleterious phases are present in any alloy of interest.

Additions of Al, Ti, Nb, Hf, Mn and V to $Ni_3Si$ offer the prospect of increased mechanical properties. Additions of Al, Cr, and Ta may improve surface stability. Of the quantity (Si+X), we prefer that silicon constitute at least half that quantity on an atomic basis. It is anticipated that the skilled artisan may choose to add minor amounts of other elements for various purposes without losing the benefits which arise from the application of the invention process to the previous described class of compositions.

In analogous fashion it is anticipated that certain elements could be added in partial substitution for nickel. These include Co, Cu, Pd, Pt and Au. However these elements have not been investigated and there is currently no known advantage to their use. Usage of these elements is subject to the requirements that the $Ll_2$ phase structure be preserved and that no significant quantities of extraneous phases be formed.

The invention process is successful in large measure because of the ductility of the $Ni_3Si$ phase. Most intermetallic compounds are hard and brittle and cannot be deformed without cracking. The $Ni_3Si$ phase however is ductile and can be worked even in cast form. The ductility of $Ni_3Si$ is apparently due to the phase having an $Ll_2$ crystal structure. The earlier discussion of elements which might be added must be qualified to require that the resultant micro structure maintain this $Ll_2$ crystal structure. These alloying variations will occur to the skilled artisan and may necessitate some minor variation of the processing steps but they are all deemed within the scope of the invention.

U.S. Pat. No. 4,481,047 which shares a common assignee with the present application describes a processing method similar to that to be described below, but applies the process to a different alloy. The present composition is less dense and shows a greater texture increase than the material discussed in U.S. Pat. No. 4,481,047.

FIG. 1 in the present application is a flowchart indicating the processing used to arrive at the objective of the present invention. The starting material may be in the form of a casting or powder. If the powder approach is selected, the first step is to can the powder by enclosing it in an evacuated thin wall deformable container. In the case of cast starting materials, this step is not necessary. The material step is then hot deformed in an axisymmetric manner (at a temperature in excess of about 1000° F.) with the axis about which the deformation is performed corresponding essentially to the axis along which the desired modulus improvement is desired. By axisymmetric deformation, I mean deformation essentially normal to the axis, performed essentially uniformly 360° about the axis. This deformation is preferably performed by extrusion although swaging is an alternative (but in the case of powder, extrusion is necessary for powder compaction). A total hot deformation equal to that achieved by extrusion at a ratio of about 10:1 and preferably greater than about 15:1 is desired in order to derive a strong <111> texture.

The second deformation step is performed cold (at less than about 500° F.) to intensify the <111> texture. Again the cold deformation process is an axisymmetric operation (extrusion, swaging or drawing). The minimum amount of cold deformation necessary is equvilent to that produced by a 30% reduction in cross section area.

EXAMPLE

Figure 2:
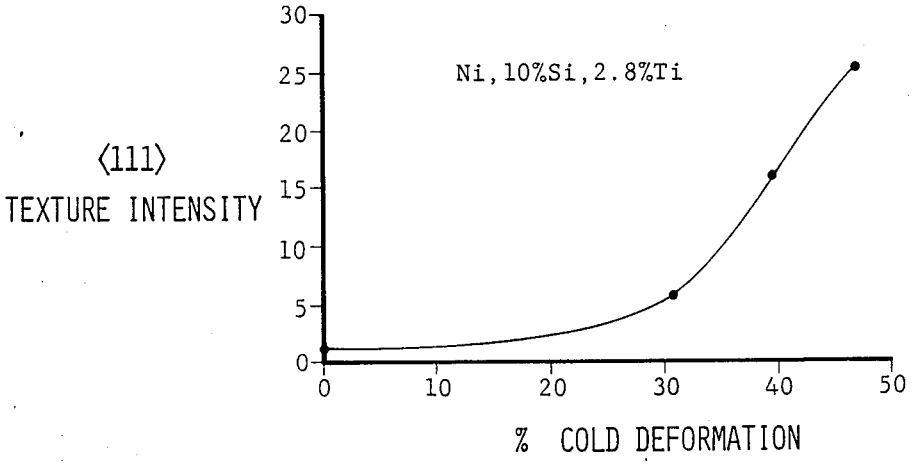
FIG. 2 is a graph illustrating the effect of cold deformation amount on texture intensity.

An alloy containing 10 wt.% silicon, 2.8 wt.% titanium, balance nickel (18.74 at.% silicon, 3.08 at.% titanium, balance nickel) was prepared in powder form and placed in a deformable thin wall nickel container which was evacuated and sealed. The canned powder was then hot extruded at a temperature of 1900° F. and an extrusion ratio of 10:1 to densify and deform the material. These operating parameters were chosen to produce a <111> texture. The extruded material was then cold swaged varying amounts with the results that are shown in FIG. 2. It can be seen that a dramatic increase in the <111> texture occurs for cold swaging amounts in excess of about 30%. Cold swaging in excess of about 30% will produce a <111> texture enhancement of at least about 5 times. Preferably the materials should be cold swaged at least 40% to produce a texture enhancement of at least about 10X.

Figure 3:
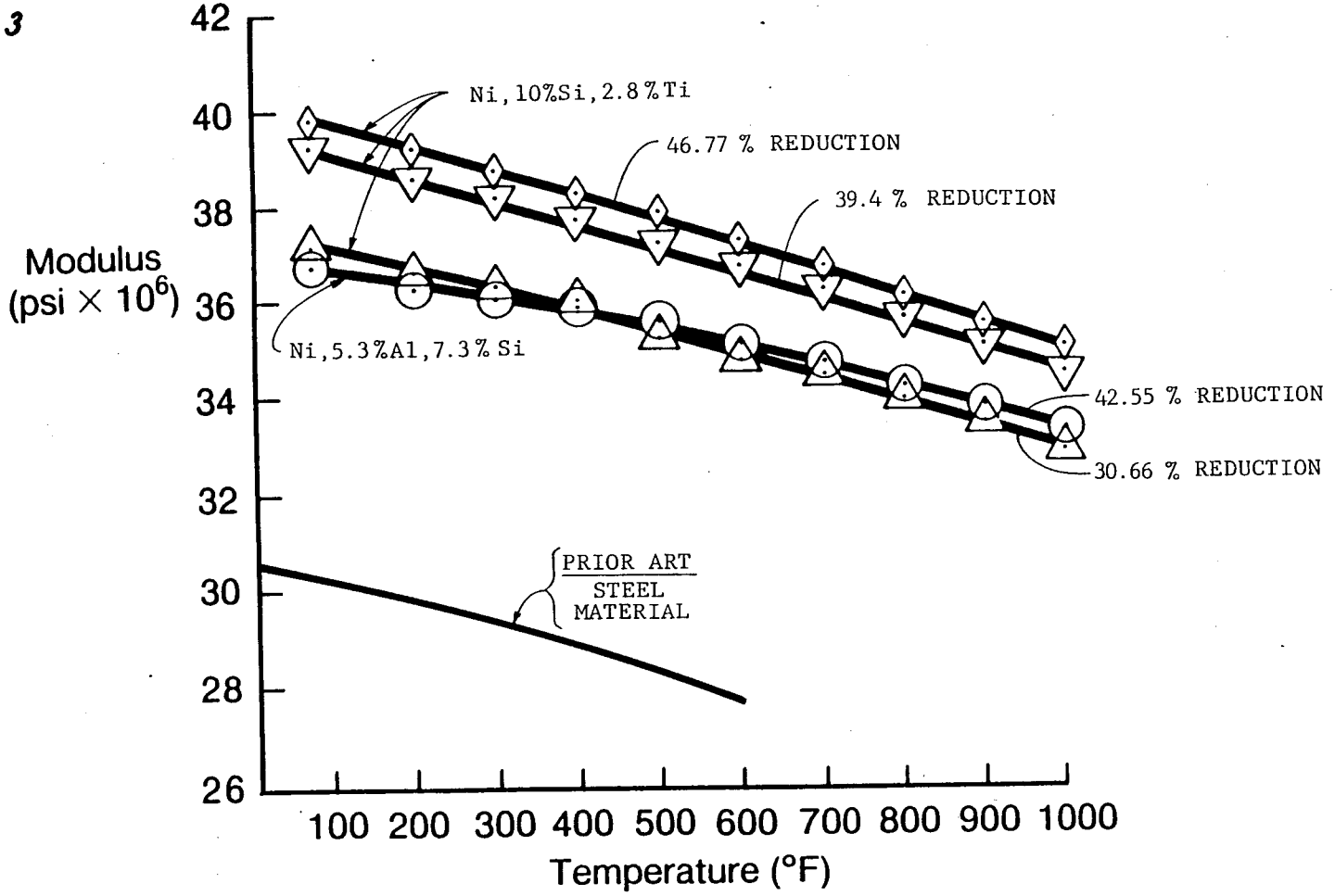
FIG. 3 is a graph illustrating the elastic modulus as a function of temperature of the invention material.

Samples of this material were evaluated to determine their elastic modulus as a function of temperature with the results shown in FIG. 3. Also shown in FIG. 3 is a curve for the steel material conventionally used as turbine shafting. It can be seen that over the entire temperature range evaluated that the invention material has a modulus about 30% greater than that of the prior art steel shaft material. Since the density of the invention material is comparable to that of the prior art iron base materials (and even less for some alloys) it is apparent that the present invention can provide material having a greater stiffness than the prior art material with no weight penalty.

Although this invention has been shown and described with respect to detailed embodiments thereof, it will be understood by those skilled in the art that various changes in form and detail thereof may be made without departing from the spirit and scope of the claimed invention.

TABLE 1

| "X" Alloying Element | Range of Addition Atomic % |
|---|---|
| Ti | 0–12 |
| Nb | 0–2 |
| Mn | 0–3 |
| Al | 0–12 |
| Ga | 0–12 |
| Ge | 0–12 |
| Hf | 0–6 |
| Ta | 0–5 |
| V | 0–8 |
| Mo | 0–5 |
| Cr | 0–8 |

I claim:

1. An article which comprises: a nickel base alloy containing more than about 50 volume percent of a strengthening phase of the $Ni_3(Si+X)$, said article having a <111> texture which is at least five times random along a particular axis and a high modulus of elasticity along the same axis.

2. An article as in claim 1 having a composition consisting essentially of 20–25 at.% (Si+X), balance essentially nickel.

3. A method of producing an article having a high modulus of elasticity along a certain axis which comprises:

providing as a starting material a nickel base material containing a minimum of 50% volume fraction of a phase based on $Ni_3Si$;

hot deforming the material in an axisymmetric manner about the axis along which the high modulus is desired to produce a singular <111> texture along said axis;

cold deforming the material in an axisymmetric manner about the axis along which the high modulus is desired;

whereby the <111> texture is intensified to at least five times random, and an enhanced modulus of elasticity along the desired axis results.

4. A method as in claim 3 in which the alloy has a composition consisting essentially of 15–25 at.% (Si+Hf+Al+Ti+Nb+Ta) and the Si is present in an amount of at least 12.5 at.%.

5. A method as in claim 3 in which the starting material is in powder form and is placed in a deformable container and hot extruded an amount in exess of 10:1.

6. A method as in claim 3 in which the amount of hot axisymmetric deformation is in excess of about 15:1.

* * * * *